US005264155A

United States Patent [19]

Yorke

[11] Patent Number: 5,264,155

[45] Date of Patent: Nov. 23, 1993

[54] METHODS FOR INHIBITING THE CORROSION AND DEPOSITION OF IRON AND IRON CONTAINING METALS IN AQUEOUS SYSTEMS

[75] Inventor: William J. Yorke, Newtown, Pa.

[73] Assignee: Betz Laboratories, Inc., Trevose, Pa.

[21] Appl. No.: 893,183

[22] Filed: Jun. 3, 1992

[51] Int. Cl.[5] ..... C23F 11/14

[52] U.S. Cl. ..... 252/392; 252/393; 252/394; 422/16

[58] Field of Search ..... 252/392, 396, 393; 422/16

[56] References Cited

U.S. PATENT DOCUMENTS

| | | | |
|---|---|---|---|
| 3,714,066 | 1/1973 | King et al. | 253/181 X |
| 3,714,067 | 1/1973 | King et al. | 252/181 X |
| 3,723,347 | 3/1973 | Mitchell | 252/181 X |
| 3,959,166 | 5/1976 | Oberhofer | 252/75 X |
| 4,487,745 | 12/1984 | Weiss et al. | 422/16 |
| 4,725,320 | 2/1988 | Tury et al. | 148/6.14 |
| 4,814,010 | 3/1989 | Tury | 106/14.31 |
| 4,865,647 | 9/1989 | John et al. | 106/14.15 |
| 4,980,128 | 12/1990 | Cuisia | 422/16 |
| 5,047,094 | 9/1991 | Tury et al. | 148/248 |

OTHER PUBLICATIONS

N. Guest, et al., Proc. Electrochem. Soc., 89-13 (Proc. Symp. Adv. Corros. Prot. Org. Coat.) pp. 430–436.

*Primary Examiner*—Robert L. Stoll
*Assistant Examiner*—Valerie Fee
*Attorney, Agent, or Firm*—Alexander D. Ricci; Philip H. Von Neida

[57] ABSTRACT

Methods are provided for inhibiting the corrosion of iron and iron-containing metals in contact with aqueous systems. Salicylaldoxime is added to cooling water systems to inhibit the corrosion of these metal surfaces.

4 Claims, No Drawings

METHODS FOR INHIBITING THE CORROSION AND DEPOSITION OF IRON AND IRON CONTAINING METALS IN AQUEOUS SYSTEMS

FIELD OF THE INVENTION

The present invention pertains to methods for inhibiting the corrosion of iron and iron-containing metals in industrial cooling water systems.

BACKGROUND OF THE INVENTION

In many industrial processes, undesirable excess heat is removed by the use of heat exchangers in which water is used as the heat exchange fluid. The term "cooling water" is applied wherever water is circulated through equipment to absorb and carry away heat. This definition includes air conditioning systems, engine jacket systems, refrigeration systems as well as the multitudes of industrial heat exchange operations, such as found in oil refineries, chemical plants, steel mills, etc.

The use of a recirculating system, in which a cooling tower, spray pond, evaporative condenser and the like serve to dissipate heat, permits great economy in makeup water requirements. In a cooling water system employing a cooling tower, water is circulated through the heat transfer equipment and subsequently cooled by evaporation of a part of the circulating water as the water is passed over the cooling tower. By virtue of the evaporation which takes place in cooling, the dissolved solids and suspended solids in the water become concentrated. The circulating water becomes more concentrated than the makeup water due to this evaporation loss.

"Cycles of concentration" is the phrase employed to indicate the degree of concentration of the circulating water as compared with the makeup. For example, 2.0 cycles of con centration indicates the circulating water is twice the concentration of the makeup water. To maintain the circulating water at some given cycles of concentration, a portion of the circular water must be physically removed from the system and replaced with fresh makeup water to maintain a steady-state condition. The circulating water removed from the system is referred to as "blowdown".

Preventing the corrosion of industrial heat transfer equipment is essential to the efficient and economical operation of a cooling system. Excessive corrosion of metallic surfaces can cause the premature failure of process equipment, necessitating downtime for the replacement or repair of the equipment.

Additionally, the buildup of corrosion products on heat transfer surfaces impedes water flow and reduces heat transfer efficiency, thereby limiting production or requiring down time for cleaning, and can also cause rapid localized corrosion and subsequent penetration of metallic surfaces through the formation of differential oxygen concentration cells. The localized corrosion resulting from differential oxygen cells originating from deposits is commonly referred to as "under-deposit corrosion". "Galvanic corrosion" can also occur if the corrosion products include metals different from that of the metal surface.

With the advent of strict Federal, State and Municipal Environmental controls and water shortages throughout the country, recirculating cooling water systems were, in many cases, forced to operate at higher cycles of concentration to reduce both water consumption and the volume of blowdown from the system. As the cycles of concentration increase, corrosion problems become more severe because of the higher dissolved salt concentrations that are encountered. Higher cycles will also increase the concentration of corrosive agents that are not present in the makeup water, but are introduced during the course of the cooling operation. These may include, for example, hypochlorite ions added for their biocidal action, sulfide ions present through process leaks, sulfate or chloride ions added as their hydrogen acids to control pH, or corrosion products that are dissolved, dispersed or redeposited throughout the system.

SUMMARY OF THE INVENTION

The present invention relates to methods for inhibiting the corrosion of iron and iron-containing metal surfaces in contact with an aqueous medium. An effective inhibiting amount of salicylaldoxime is added to the aqueous system experiencing this corrosion. Salicylaldoxime is particularly effective at inhibiting corrosion in recirculating cooling systems.

DESCRIPTION OF THE RELATED ART

U.S. Pat. No. 4,725,320, Tury et al., teaches a method for treating metal I surfaces such as iron with an alkyl-substituted hydroxyoxime complex of metal II. Tury et al., U.S. Pat. No. 5,047,094 teaches using a different alkyl-substituted hydroxyoxime compound in the metal II complex to treat metal I surfaces.

U.S. Pat. No. 4,865,647, John et al., teaches processes and compositions for inhibiting metal corrosion by applying the composition to the metal surface. The compositions comprise a substituted cyclic anhydride and a hydroxyoxime in a suitable organic solvent. Tury, U.S. Pat. No. 4,814,010, teaches methods for inhibiting metal corrosion by applying a polyester compound having a terminal group such as an amine. This compound can additionally be employed with a hydroxyamine compound.

The compositions taught in these cited patents contain alkyl-substituted salicylaldoximes in organic solvents or aqueous dispersions that are applied to metal surfaces by dipping, spraying, or brushing. These applications differ from those of the present invention, which involves unsubstituted salicylaldoxime present in low concentration in water conditioned for industrial use.

Substituted salicylaldoxime compounds where the R group is para to the hydroxy group and is a higher alkyl group show effectiveness at inhibiting corrosion in mild steels through the formation of a macroscopic organic film on the steel surface. N. Guest, et al., Proc. Electrochem, Soc., 89-13 (Proc. Symp. Adv. Corros. Prot. Org. Coat.) pp 430–436.

DETAILED DESCRIPTION OF THE INVENTION

The present invention relates to methods for inhibiting the corrosion of iron and iron-containing metal surfaces in contact with an aqueous system comprising adding an effective inhibiting amount of salicylaldoxime.

Salicylaldoxime has the structure

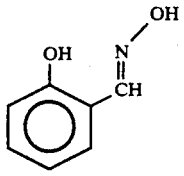

which is formed by reacting hydroxylamine with salicylaldehyde.

The methods of the instant invention are effective under the adverse conditions which often are experienced in cooling water systems. These adverse conditions typically arise when oxidizing biocides are present. Further contributing to this corrosive condition are corrosion by-products from other metallurgies, contamination from sulfide leaks and long system retention time.

The total amount of salicylaldoxime used in the methods of the present invention is that amount which is sufficient to inhibit corrosion in the cooling water system and will vary according to the conditions in the cooling water system. Higher sulfide and biocide concentrations and longer retention times will require larger amounts of salicylaldoxime to be added to the cooling water system.

Salicylaldoxime can be added to the cooling water system in an amount ranging from about 0.1 to about 50 parts per million parts water. The preferred dosage is 3 to 10 parts per million parts water.

Other corrosion inhibitors and dispersants may be used in combination with the salicylaldoxime. These methods may also be applied with other water treatment agents, such as microbiological control species like oxidizing and nonoxidizing biocides.

One advantage of the present invention is that it is capable of maintaining low iron metal corrosion rates under aggressive conditions that occur when both an oxidizing biocide, such as hypochlorite, and sulfide ions are present in the cooling water system at the same time.

The salicylaldoxime can be added to the cooling water system by any conventional manner. Preferably this compound is added as an aqueous solution. The addition of this solution may be either intermittent or continuous.

The data set forth below illustrate this invention. These examples are only illustrations and should not be construed as limiting the scope thereof.

EXAMPLES

All tests were carried out in a recirculator containing both low carbon steel and Admiralty Brass Metallurgy. The temperature was kept at 120° F. and the pH actively controlled at 7.2. Results are reported as straight-line corrosion rates expressed as mills per year (mpy), on pairs of low carbon steel coupons.

The water composition in the recirculator was as follows:

| | |
|---|---|
| Calcium | 500 ppm as $CaCO_3$ |
| Magnesium | 250 ppm as $CaCO_3$ |
| Chloride | 354 ppm as Cl |
| Sulfate | 240 ppm as $SO_4$ |
| Orthophosphate | 15 ppm as $PO_4$ |
| Pyrophosphate | 3 ppm as $PO_4$ |
| 1-hydroxyethylidene-1,1-diphosphonic acid | 2.4 ppm as $PO_4$ |
| Polymer Dispersant | 6 ppm as active Polymer |
| Tolyltriazole | 3 ppm as Tolyltriazole |

EXAMPLE A

Adverse chlorinated conditions were simulated in the recirculator by the following procedure: the metal was allowed to passivate for 1 day without hypochlorite; sodium hypochlorite (4 ml of 5% aqueous sodium hypochlorite) was shot fed into the 11 liter sump and the system retention time was prolonged by reducing the blowdown (sump replenishment rate) to one quarter of the original rate. The remainder of the 6 day run was carried out at this reduced blowdown to demonstrate the effects of the corrosion by-products. The dosage of salicylaldoxime was 6 parts per million. These results are reported in Table I.

TABLE I

Recirculator Testing Under Adverse Chlorinated Conditions

| Treatment | Corrosion Rate (mpy) | |
|---|---|---|
| Control | 6.2 | 5.8 |
| Salicylaldoxime | 1.0 | 1.0 |

The long retention time serves to intensify the corrosion effects of reaction by-products. As shown in Table I, the addition of salicylaldoxime significantly reduced the corrosion of the low carbon steel coupons.

EXAMPLE B

The adverse conditions of combined sulfide and chlorination was simulated by the continual feed of both a 0.1% (as $H_2S$) aqueous solution of sodium sulfide at the rate of 1 ml per hour, and a 0.9% aqueous solution of sodium hypochlorite at the rate of 1 ml per hour, into the 11 liter system. Salicylaldoxime was present at 6 parts per million. These results are presented in Table II.

TABLE II

Recirculator Testing Under the Combined Adverse Sulfide and Chlorination Conditions

| Treatment | Exposure (Days) | Corrosion Rate (mpy) | |
|---|---|---|---|
| Control | 3 | 8.0 | 7.8 |
| Salicylaldoxime | 3 | 5.4 | 5.2 |
| Control | 6 | 9.4 | 11.7 |
| Salicylaldoxime | 6 | 3.6 | 3.4 |

As seen in Table II, improved corrosion rates were achieved in the 3 day test employing salicylaldoxime, under the harsh conditions of both sulfide and chloride being present. The use of salicylaldoxime proved even more effective in the 6 day test.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what I claim is:

1. A method for inhibiting the corrosion of iron and iron-containing metal surfaces in contact with an aqueous system comprising adding from about 0.1 part to about 50 parts per million parts of salicylaldoxime to said system.

2. The method as claimed in claim 1 wherein said aqueous system contains sodium sulfide.

3. The method as claimed in claim 1 wherein said salicylaldoxime is added to said aqueous system in a dissolved form.

4. The method as claimed in claim 1 wherein said aqueous system is a cooling water system.

* * * * *

UNITED STATES PATENT AND TRADEMARK OFFICE

CERTIFICATE OF CORRECTION

PATENT NO. : 5,264,155

DATED : November 23, 1993

INVENTOR(S) : William J. Yorke

It is certified that error appears in the above-identified patent and that said Letters Patent is hereby corrected as shown below:

Column 4, claim 1, line 60, after the word "salicylaldoxime", insert --and an oxidizing biocide consisting of sodium hypochlorite or chlorine--.

Signed and Sealed this

Sixth Day of September, 1994

Bruce Lehman

*Attest:*

BRUCE LEHMAN

*Attesting Officer*

*Commissioner of Patents and Trademarks*